US007963812B2

(12) United States Patent
Ilkhanov

(10) Patent No.: US 7,963,812 B2
(45) Date of Patent: Jun. 21, 2011

(54) WIRE TERMINATION APPARATUS AND METHOD

(75) Inventor: Azer Ilkhanov, Brooklyn, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 13 days.

(21) Appl. No.: 12/474,640

(22) Filed: May 29, 2009

(65) Prior Publication Data

US 2010/0304596 A1 Dec. 2, 2010

(51) Int. Cl.
*H01R 4/66* (2006.01)

(52) U.S. Cl. ..... 439/806; 439/864; 439/107

(58) Field of Classification Search ..... 439/806, 439/864, 863, 107, 106
See application file for complete search history.

(56) References Cited

U.S. PATENT DOCUMENTS

| | | | | |
|---|---|---|---|---|
| 1,994,880 | A | | 3/1935 | Wallbillich |
| 2,015,858 | A | | 10/1935 | Leviton |
| 2,082,994 | A | | 6/1937 | Wallbillich |
| 2,163,722 | A | | 6/1939 | Wallbillich |
| 2,175,098 | A | | 10/1939 | Wertzheiser |
| 2,201,743 | A | | 5/1940 | Petersen |
| 2,201,751 | A | | 5/1940 | Wertzheiser |
| 2,238,386 | A | | 4/1941 | Frank |
| 2,506,212 | A | | 5/1950 | Grohsgal |
| 2,952,831 | A | | 9/1960 | Ehrlich |
| 3,431,546 | A | | 3/1969 | Averill |
| 3,439,315 | A | | 4/1969 | Hamel et al. |
| 3,713,071 | A | | 1/1973 | Poliak et al. |
| 3,740,613 | A | | 6/1973 | Strachan |
| 3,793,607 | A | | 2/1974 | Smith et al. |
| 3,904,266 | A | | 9/1975 | Fitzpatrick |
| 3,944,314 | A | | 3/1976 | Weitzman et al. |
| 3,945,711 | A | | 3/1976 | Hohorst et al. |
| 3,999,829 | A | * | 12/1976 | Glaesel ..... 439/437 |
| 4,060,305 | A | | 11/1977 | Poliak et al. |
| 4,099,826 | A | | 7/1978 | Mazzeo et al. |
| 4,172,628 | A | | 10/1979 | Lingaraju |
| 4,255,655 | A | | 3/1981 | Kikuchi |
| 4,296,987 | A | | 10/1981 | Lingaraji |
| 4,372,693 | A | | 2/1983 | Lutz |
| 4,537,560 | A | | 8/1985 | Emeterio et al. |
| 4,541,679 | A | * | 9/1985 | Fiedler et al. ..... 439/395 |
| 4,601,451 | A | * | 7/1986 | Leonardo ..... 248/74.1 |
| 4,767,340 | A | | 8/1988 | Hohorst |
| 4,793,823 | A | * | 12/1988 | Cozzens et al. ..... 439/409 |
| 4,886,472 | A | | 12/1989 | Tsai |

(Continued)

FOREIGN PATENT DOCUMENTS

| | | |
|---|---|---|
| CA | 981354 | 1/1976 |

(Continued)

OTHER PUBLICATIONS

PCT Notification of Transmittal of the International Search Report and the Written Opinion of the International Searching Authority for PCT/US2007/007596, dated Sep. 10.

(Continued)

*Primary Examiner* — Gary F. Paumen
(74) *Attorney, Agent, or Firm* — Carter, DeLuca, Farrell & Schmidt, LLP

(57) ABSTRACT

An electrical termination and method comprising an element and a conductive member is disclosed. A wire is manually or tool-lessly securable in electrical communication with the conductive member.

65 Claims, 13 Drawing Sheets

U.S. PATENT DOCUMENTS

| | | | | |
|---|---|---|---|---|
| 4,995,829 | A | 2/1991 | Geib et al. | |
| 5,015,201 | A | 5/1991 | Brezee et al. | |
| 5,181,310 | A | 1/1993 | Josephson | |
| 5,262,749 | A | 11/1993 | Kopelman | |
| 5,269,695 | A * | 12/1993 | Opel | 439/107 |
| 5,637,011 | A | 6/1997 | Meyerhoefer et al. | |
| 5,810,628 | A * | 9/1998 | Trudel et al. | 439/864 |
| 5,825,602 | A | 10/1998 | Tosaka et al. | |
| 5,866,844 | A | 2/1999 | Osterbrock et al. | |
| 5,938,488 | A * | 8/1999 | Wilmes | 439/864 |
| 5,975,940 | A | 11/1999 | Hartmann et al. | |
| 5,995,350 | A | 11/1999 | Kopelman | |
| 6,036,532 | A * | 3/2000 | Feistkorn | 439/495 |
| 6,049,143 | A | 4/2000 | Simpson et al. | |
| 6,142,787 | A * | 11/2000 | Ikesugi | 439/15 |
| 6,388,216 | B1 | 5/2002 | Puhalla et al. | |
| 6,406,323 | B2 | 6/2002 | Chung Long Shan | |
| 6,477,021 | B1 | 11/2002 | Haun et al. | |
| 6,689,955 | B2 | 2/2004 | Doutaz | |
| 6,707,652 | B2 | 3/2004 | Engel | |
| 6,712,641 | B2 | 3/2004 | Beege et al. | |
| 6,743,029 | B1 | 6/2004 | Greene et al. | |
| 6,750,402 | B2 | 6/2004 | Geske | |
| 6,786,779 | B2 | 9/2004 | Feldmeier et al. | |
| 6,802,747 | B1 | 10/2004 | Orange | |
| 6,827,602 | B2 | 12/2004 | Greene et al. | |
| 6,861,189 | B1 | 3/2005 | Greene et al. | |
| 6,926,543 | B2 | 8/2005 | Poh et al. | |
| 6,943,310 | B2 | 9/2005 | Eisenhower | |
| 6,948,846 | B2 | 9/2005 | Engel | |
| 7,077,711 | B1 * | 7/2006 | Moore | 439/864 |
| 7,097,518 | B2 * | 8/2006 | Kraemer et al. | 439/806 |
| 7,103,968 | B2 | 9/2006 | Karrasch | |
| 7,114,986 | B1 | 10/2006 | Toly | |
| 7,115,001 | B1 | 10/2006 | Brockman et al. | |
| 7,118,404 | B2 | 10/2006 | Ploesser | |
| 7,140,887 | B2 | 11/2006 | Poh et al. | |
| 7,150,646 | B2 | 12/2006 | Trumper | |
| 7,164,082 | B2 | 1/2007 | Kurek et al. | |
| 7,175,485 | B1 | 2/2007 | Alderson et al. | |
| 7,241,188 | B2 | 7/2007 | Lin et al. | |
| 7,249,963 | B2 | 7/2007 | Ramm | |
| 7,270,581 | B2 | 9/2007 | Tiberio | |
| 7,547,226 | B2 | 6/2009 | Koessler | |
| 7,651,363 | B2 | 1/2010 | Koellmann | |
| 2004/0077210 | A1 | 4/2004 | Kollmann | |
| 2005/0090159 | A1 | 4/2005 | Luther et al. | |
| 2005/0212646 | A1 | 9/2005 | Watchorn | |
| 2006/0028316 | A1 | 2/2006 | Fabian et al. | |
| 2007/0026701 | A1 | 2/2007 | Kurek et al. | |
| 2007/0238348 | A1 | 10/2007 | Kopelman | |
| 2007/0298637 | A1 * | 12/2007 | Matsuura et al. | 439/157 |
| 2008/0013239 | A1 | 1/2008 | Kopelman | |

FOREIGN PATENT DOCUMENTS

| | | | |
|---|---|---|---|
| CA | 1202095 | | 3/1986 |
| CA | 1203591 | | 4/1986 |
| CA | D60972 | | 5/1988 |
| DE | 550 863 | C | 5/1932 |
| EP | 01553660 | A1 | 7/2005 |
| EP | 01490928 | B1 | 10/2005 |
| EP | 1608039 | A1 | 12/2005 |
| FR | 2 312 767 | | 12/1976 |
| GB | 2 292 850 | A | 3/1996 |
| GB | 2 393 043 | A | 3/2004 |
| JP | 61 014529 | A | 1/1986 |
| WO | WO 97/03480 | | 1/1997 |

OTHER PUBLICATIONS

PCT International Search Report for PCT/US/2007/009433 dated Dec. 20, 2007.

Wago Innovative Connections, Wago Main Selection Page, www.connex-electronics.com/html/products/wago_main_select.html.

Wago Innovative Connections, The Wago Cage Clamp Technology, Electrical Interconnections.

Wago Innovative Connections, 773 Pushwire Connectors, For 10 AWG, Electrical Interconnections.

Wago Innovative Connections, LEVER-NUTS, 222 Series: 3 or 5 COnductor Compact Connectors, Electrical Interconnections.

* cited by examiner

WIRE TERMINATION APPARATUS AND METHOD

BACKGROUND

1. Technical Field

The present disclosure relates to wiring devices, and in particular, to wiring devices having wire termination subassemblies.

2. Description of Related Art

Wiring devices are typically provided with device terminations for terminating electrical conductors/wires, for example, load terminations, line terminations, ground terminations, etc. Together these terminations, depending on the mechanical configuration, may be connected to electrical conductors/wires using several presently known termination techniques. One such termination is referred to as "side-wire" (sometimes referred to as "wrap-wire") termination. To terminate a conductor/wire using a side-wire terminal, an end of the wire is initially stripped, exposing a portion of the end of the wire, and this exposed portion is then wrapped around a terminal screw. The screw is then tightened causing the head of the screw to secure the exposed wire between the head of the screw and a metallic terminal plate (e.g., a brass terminal).

Another type of wire termination is referred to as "back-wire" (also referred to as "clamp-wire"). In back-wire terminals, a screw passes through a first metallic plate and threads into a second metallic plate (referred to as a clamp) to compress a wire therebetween. The first metallic plate (or brass terminal) has a clearance opening and slides along the shaft of the screw. The second metallic plate has a threaded hole which the screw threads engage. A stripped wire is placed between the two metallic plates and the screw is tightened to compress the wire between the plates.

Yet another type of wire termination is referred to as a "push in" termination. Push-in terminations are terminals in which a small hole is available in the outer housing of a wiring device for insertion of a stripped wire therethrough. A solid-metal wire is initially stripped (e.g.—about five-eights of an inch) from the cut end. The stripped portion of the wire is inserted into the hole. A clamping mechanism, commonly in the form of a cage clamp, provides a clamping force on the wire to maintain it in contact with a terminal plate for establishing electrical contact with the wire. The clamping mechanism provides resistance against the wire being pulled out of the hole and out of contact with the terminal plate. Typically, a tool is required to release the wire; e.g., a screwdriver.

In view of the foregoing, it is desirable for wiring devices including termination mechanisms and methods of termination that provide convenient electrical terminations for various gauge conductors/wires.

SUMMARY

The present disclosure relates to an electrical distribution wiring device comprising a housing having a plurality of wire terminations. At least one of the wire terminations comprises a conductive member and a lever. The conductive member is at least partially disposed within the housing. The lever is rotationally mounted to the conductive member and is manually rotatable between at least a first position and a second position. The lever includes a rotational axis and an eccentric surface defined with respect to the axis. When the lever is in the first position, the lever allows a wire to be inserted into the wire termination. When the lever is in the second position, the lever causes the eccentric surface to secure the wire to the conductive member.

In disclosed embodiments, wherein the conductive member includes a V-like shape having two legs configured to receive the wire.

In disclosed embodiments, the conductive member includes a resilient member formed therein; the resilient member, the lever and the conductive member are configured to interact with one another to allow securement of wires of different gauges with the conductive member.

In disclosed embodiments, all exposed surfaces of the electrical distribution wiring device which can be contacted by a human finger are electrically isolated from line voltage when the lever is in its second position.

In disclosed embodiments, the lever includes an element locking structure and the housing includes a housing locking structure. The element locking structure is configured to engage the housing locking structure when the lever is moved towards its second position.

In disclosed embodiments, the conductive member comprises a first terminal, a second terminal and a conductive member breakaway portion that connects the first terminal with the second terminal. The housing includes a housing breakaway portion, which is configured to at least partially shield the conductive member breakaway portion.

In disclosed embodiments, the lever is a hand operable lever.

The present disclosure also relates to a wiring device comprising a housing, and a wire termination subassembly. The wire termination subassembly is disposed at least partially within the housing. The wire termination subassembly comprises a conductive member and an element. The element is disposed in mechanical cooperation with the conductive member and is pivotable about a first axis between a first position where a wire is insertable between the element and a portion of the conductive member, and a second position where the wire is removably secured between the element and a portion of the conductive member. The element is manually movable between the first position and the second position.

In disclosed embodiments, the conductive member comprises at least one resilient member formed therein, wherein the at least one resilient member, the element and the conductive member mechanically cooperate to allow securement of wires having different gauges.

In disclosed embodiments, the element includes an element locking structure thereon which is configured to selectively engage a housing locking structure disposed on the housing when the element is moved towards its second position.

In disclosed embodiments, the element comprises a pivot portion and the pivot portion includes a reinforcing member.

In disclosed embodiments, the element is hand operable.

The present disclosure also relates to a wire termination comprising a conductive member and a lever. The lever is rotationally mounted to the conductive member and is manually rotatable between at least a first position and a second position. The lever includes a rotational axis and an eccentric surface defined with respect to the axis. The lever in the first position allows a wire to be inserted between the lever and the conductive member, and the lever in the second position causes the eccentric surface to secure the wire to the conductive member.

The present disclosure also relates to a wire termination comprising a conductive member and an element. The element is disposed in mechanical cooperation with the conductive member and is pivotable about a first axis between a first position where a wire is insertable between the element and a portion of the conductive member, and a second position where the wire is removably secured between the element and a portion of the conductive member/The element is manually movable between the first position and the second position.

The present disclosure also relates to a method for terminating a wire. The method comprises manually moving a lever to allow a portion of a wire to be inserted between a conductive member and an eccentrically cammed surface of the lever, inserting a portion of a wire between the conductive member and the eccentrically cammed surface of the lever, and manually moving the lever to removably secure the wire between the conductive surface and the eccentrically cammed surface of the lever such that the wire is manually removable from between the conductive surface and the eccentrically cammed surface of the lever.

The present disclosure also relates to a method of manufacture for an electrical termination of a wiring device. The method includes the step of mounting a conductive member at least partially within the wiring device where the conductive member includes at least one inwardly extending resilient member, a mounting region having at least a first width, and a wire-contact portion. The method also includes the step of mounting a wire termination mechanism within the mounting region of the conductive member. The wire termination mechanism has a shaft and is pivotable about the shaft between at least a first position and a second position. The wire termination mechanism is constrained within the at least first width of the mounting region by the inwardly extending resilient member, such that manufacturing tolerances are controlled.

DESCRIPTION OF THE DRAWINGS

Various embodiments of the present disclosure are disclosed herein with reference to the drawings, wherein:

FIG. 5AA is a perspective assembly view of the wire termination subassembly of the embodiment shown in FIG. 5;

DETAILED DESCRIPTION

The present disclosure will now be described more fully hereinafter with reference to the accompanying drawings, in which embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

Figure 1:
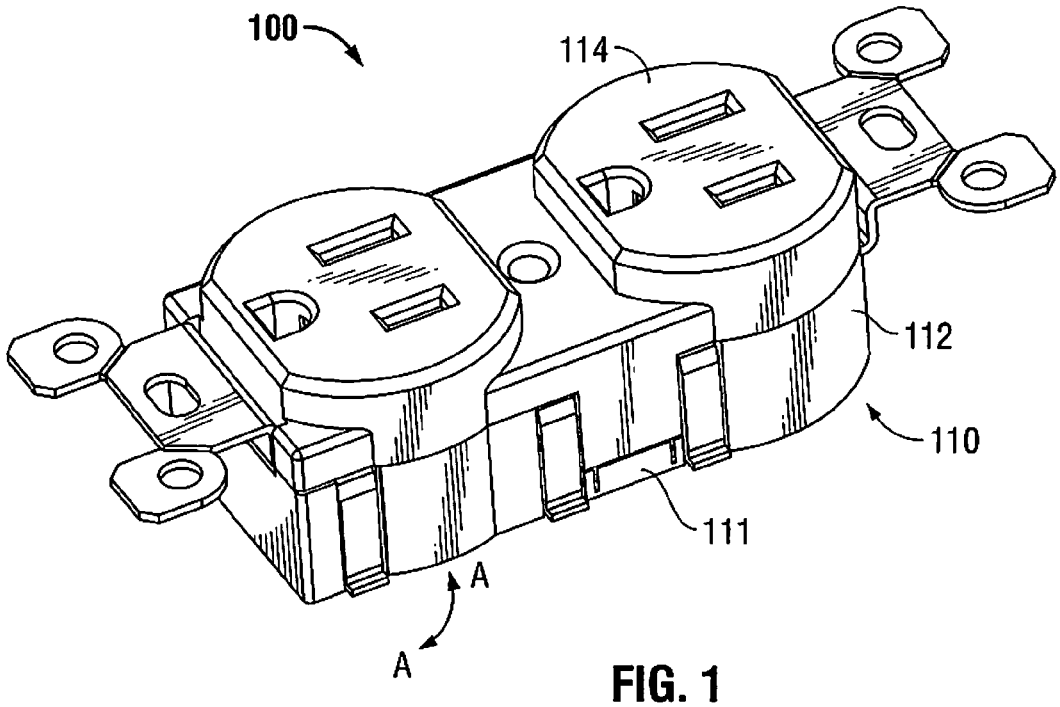
FIG. 1 is perspective view of an upper portion of a wiring device including a wire termination subassembly according to an embodiment of the present disclosure, shown in a second position.

Referring initially to FIG. 1, an electrical wiring distribution device (hereinafter "wiring device"), including at least one wire termination subassembly according to an embodiment of the present disclosure, is generally designated as 100. Wiring device 100 is in the form of an electrical receptacle, in particular, a duplex three-prong electrical receptacle for handling 15 amp current applications. However, it should be understood that the receptacle can be a two- or three-prong electrical receptacle or a receptacle other than that of a duplex receptacle. It should also be understood that the term "wiring device" is intended to include any standard electrical wiring device commonly known in the electrical industry, including but not limited to switches, ground fault circuit interrupters, dimmers, fan speed controls, occupancy sensors and the like.

Figure 5:
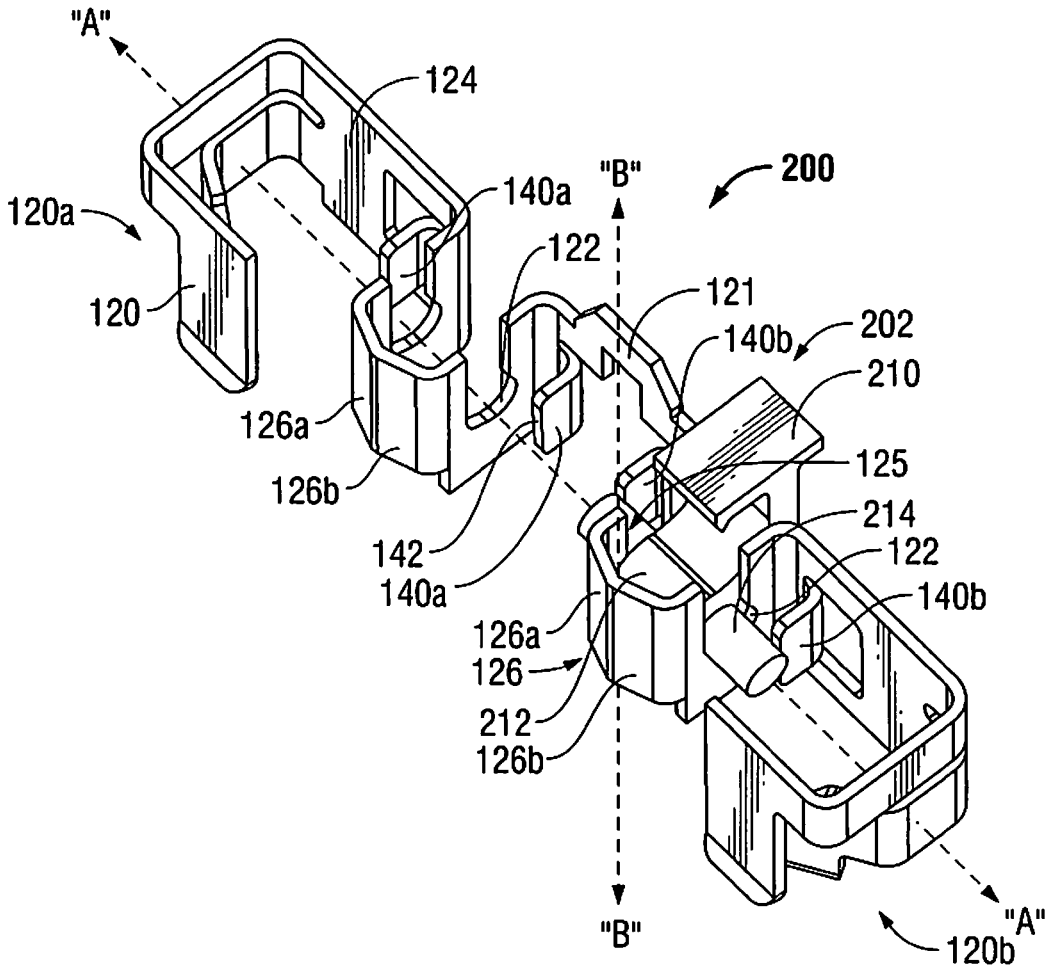
FIG. 5 is a perspective view of a wire termination subassembly for use with the wiring device of FIGS. 1-4A.

With continued reference to FIG. 1, wiring device 100 includes a housing 110 having a base portion or lower portion 112 and a cover portion or upper portion 114. Cover portion 114 configured and dimensioned for connection to base portion 112. Additionally, wiring device 100 includes a conductive member 120 (see FIGS. 3-5 and 5AA) disposed at least partially within housing 110 and at least one wire termination subassembly, generally referred to as numeral 200 (FIG. 5). Wire termination subassembly 200 is adapted and configured to removably secure/terminate a portion of a wire "W" to conductive member 120, thus enabling electrical communication between wiring device 100 and wire "W" (see FIGS. 6 and 7).

Figure 2:
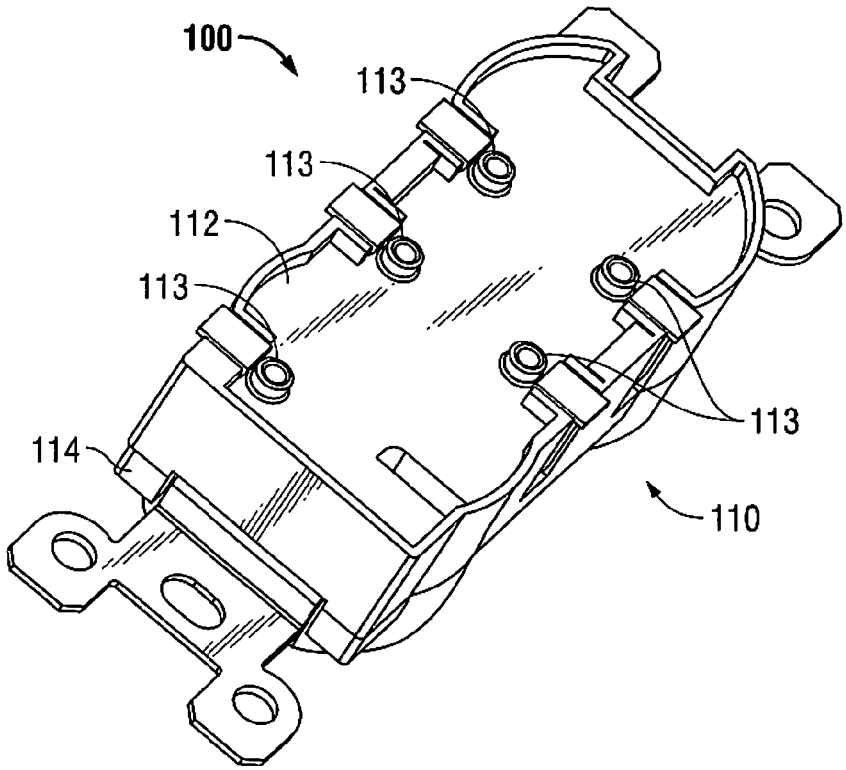
FIG. 2 is a perspective view of a lower portion of the wiring device of FIG. 1.
Figure 3:
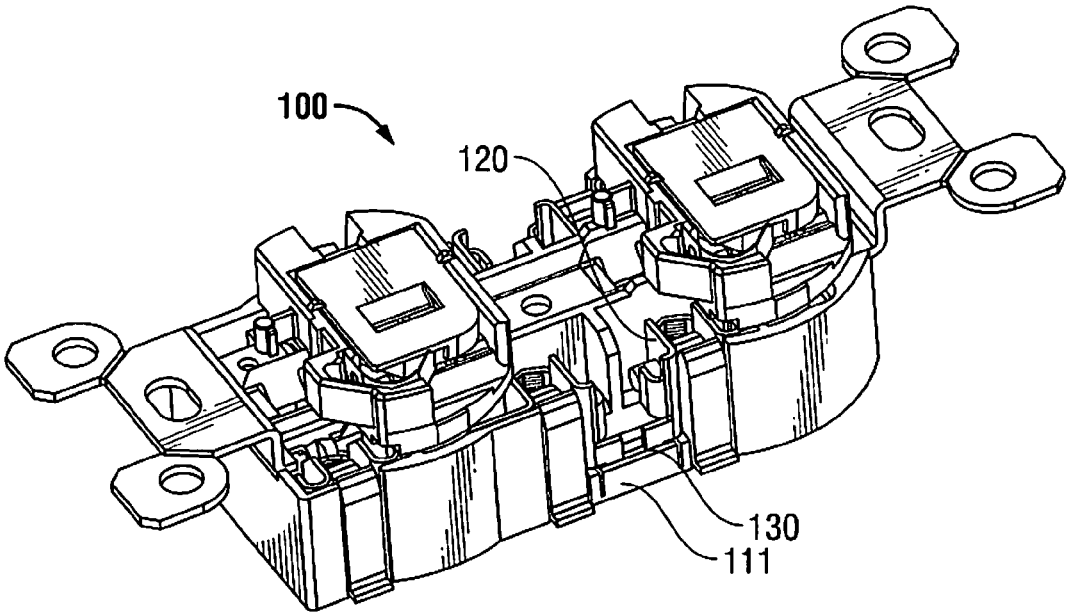
FIG. 3 is a perspective view of an upper portion of the wiring device of FIGS. 1 and 2 with portions of the wiring device removed and with elements in a second position.
Figure 4:
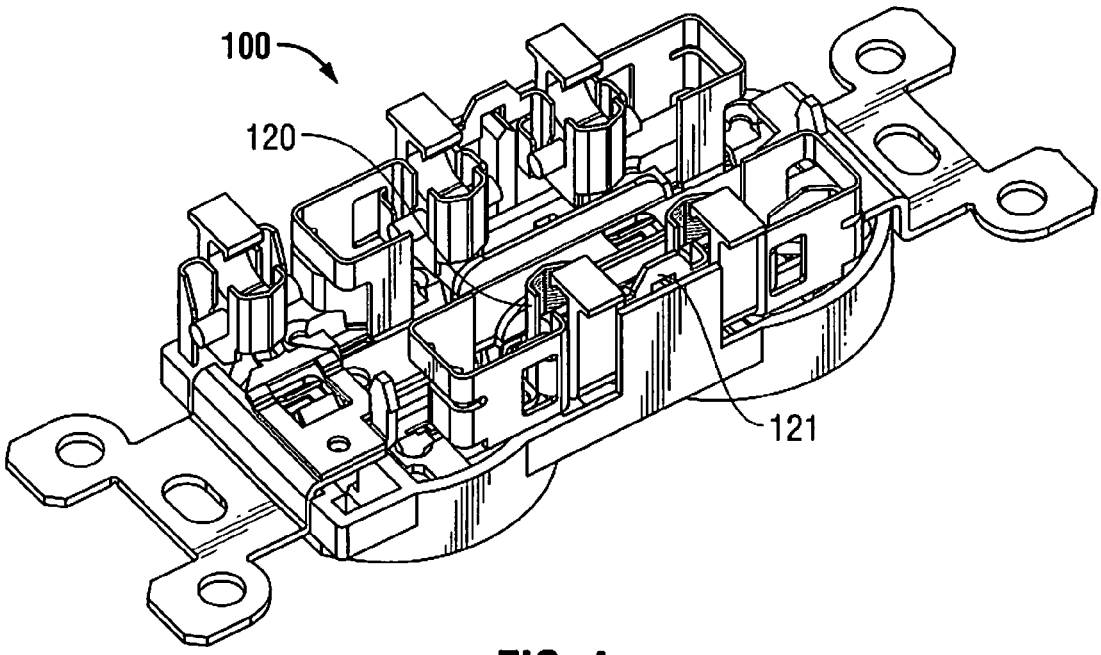
FIG. 4 is a perspective view of an upper portion of the wiring device of FIGS. 1-3 with portions of the wiring device removed and with elements in a second position.
Figure 4A:
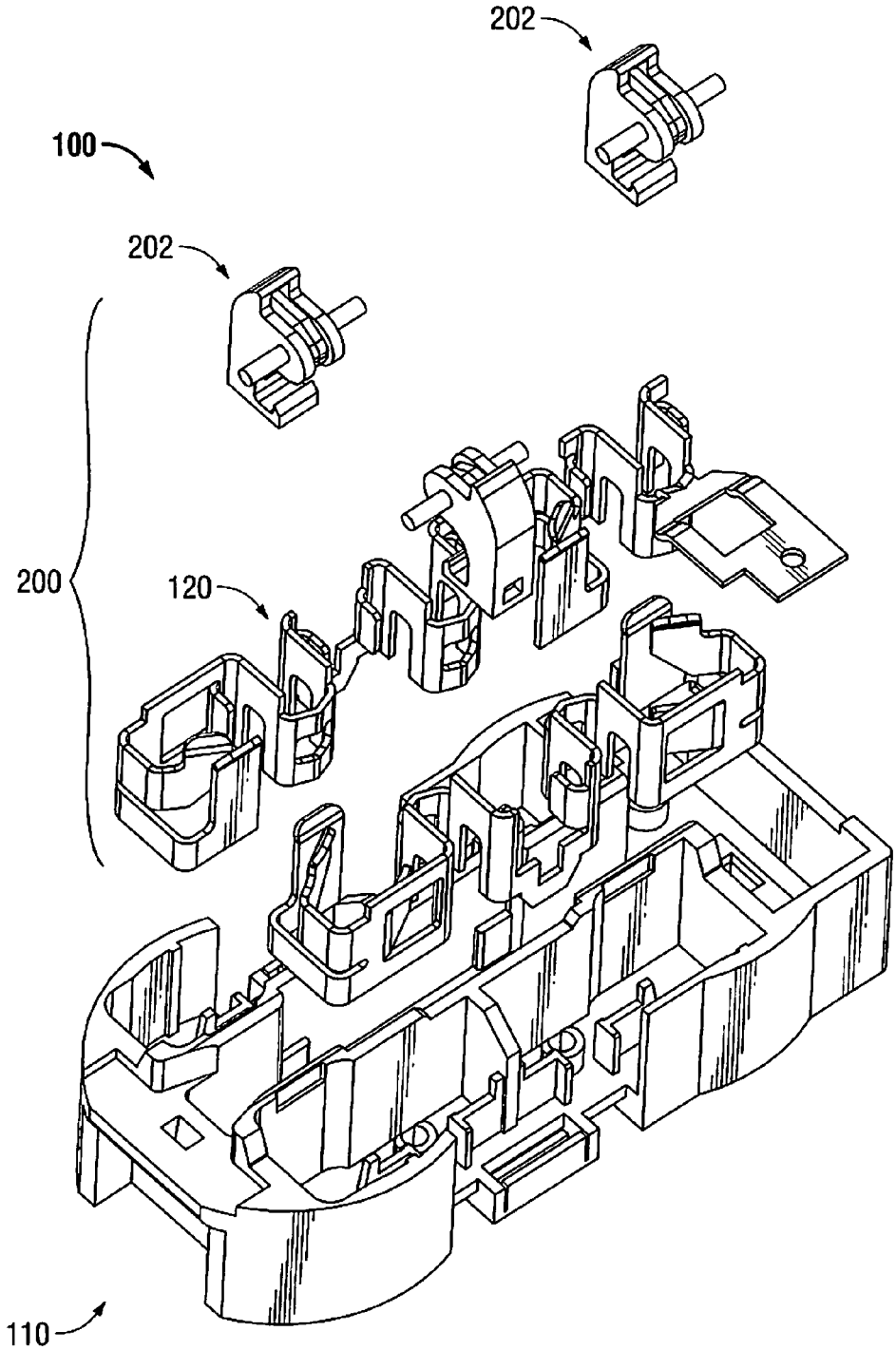
FIG. 4A is a perspective assembly view of a portion of the wiring device of FIGS. 1-4.

With reference to FIG. 2, base portion 112 of housing 110 of wiring device 100 is more clearly shown. As illustrated, base portion 112 includes a plurality of openings 113 extending therethrough. Each opening 113 is configured to accept a portion of a wire therethrough. Further, each opening 113 is substantially aligned with a portion of conductive member 120, such that a wire is insertable through opening 113 and into electrical engagement with conductive member 120 (for hot & neutral).

Figure 5A:
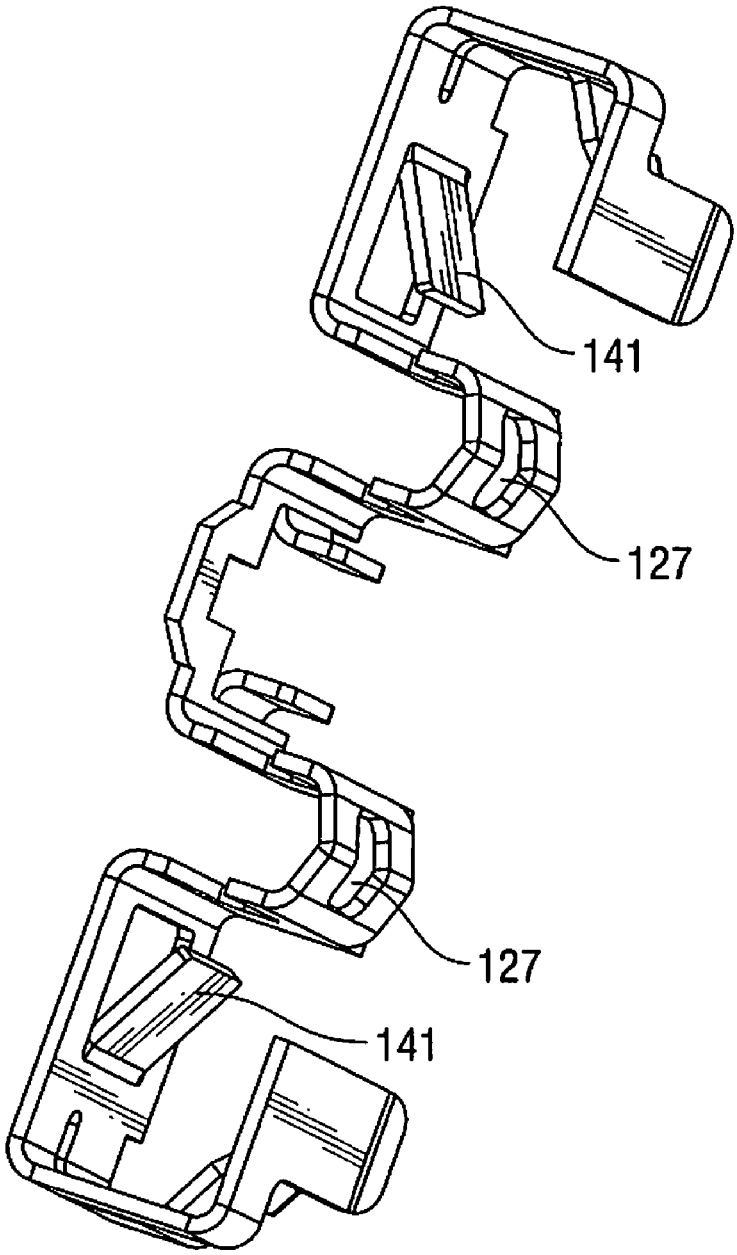
FIG. 5A is a perspective view of another embodiment of a wire termination subassembly of the embodiment shown in FIG. 5.
Figure 5A:
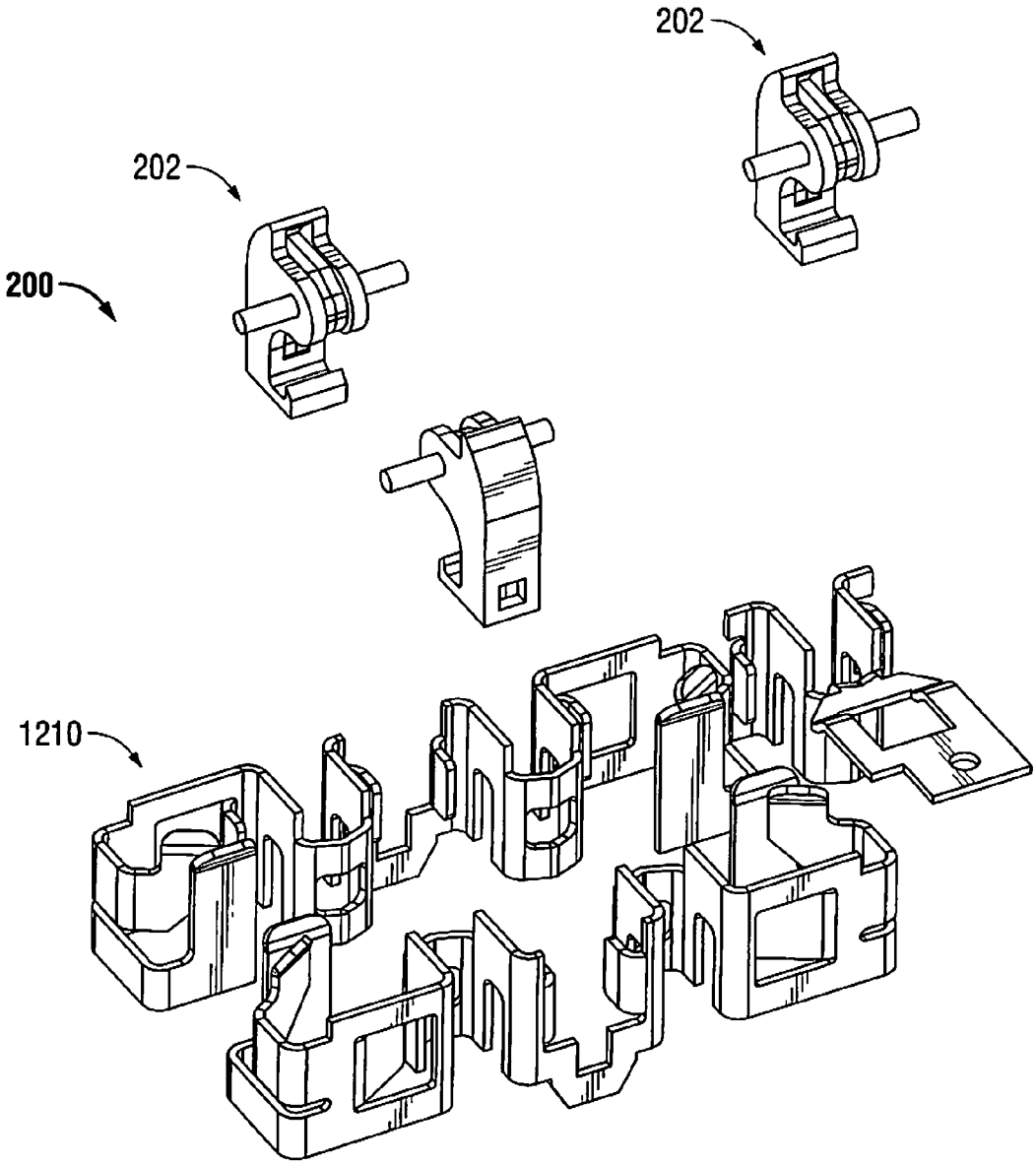

With reference to FIG. 5, components of wire termination subassembly 200 are illustrated. Wire termination subassembly 200 includes conductive member 120 and an element 202. In the illustrated embodiment, element 202 includes a hand-operable lever 210, cam 212 (FIG. 6) and pin 214. Pin 214 defines a first longitudinal axis "A-A." Element 202 is rotatable (e.g., pivotable) about pin 214. It is envisioned that first longitudinal axis "A-A" extends through the cam's axis, e.g., an off-center portion of cam 212. Thus, it is envisioned that cam 212 is an eccentric disc-like member. It is envisioned that such a cam would be adapted and configured to apply a continually increasing amount of force against wire "W"

upon movement of lever 210. Moreover, it is envisioned that the initial movement of lever 210 would require less force than when lever 210 is moved to its final position. Accordingly, for such a configured cam, it would take a relatively larger amount of force to move lever 210 back towards its initial position. Thus, as lever 210 is moved towards its second position, there is a greater force acting on a wire "W" to adequately terminate and/or help maintain the wire "W" secured between cam 212 and conductive member 120. FIG. 5AA illustrates an assembly view of the wire termination subassembly 200 of FIG. 5. Alternatively, as opposed to including cam 212, element 202 may comprise a constant radius portion. In such an embodiment, it is contemplated that the cammed surface may be provided by a channel having a varying depth or radius along the channel length such that when the element is in its first position a wire may be freely inserted and when the element 202 is moved to it's second position, the wire is secured by an increasing force due to the varying depth or radius of the channel. It is envisioned that element 202 is made entirely of a non-conductive material such as, but not limited to, plastic (polyamide 6-6 or PA66), ceramic, or the like. It is also envisioned that element 202 can comprise both non-conductive material and conductive material. For example, it is envisioned that pin 214 can be made of a non-conductive material and include a bore disposed therethrough, wherein reinforcing rod can be inserted through and extending through the bore (e.g., the reinforcing rod can be made of a metal or composite material that may be at least partially conductive). It is further disclosed that all exposed surfaces of the wiring device 100 (i.e., surfaces accessible from the exterior that can be touched/contacted with a human finger or mechanical probe) are either made of non-conductive materials and/or are electrically isolated. See also FIGS. 12-14.

Figure 12:
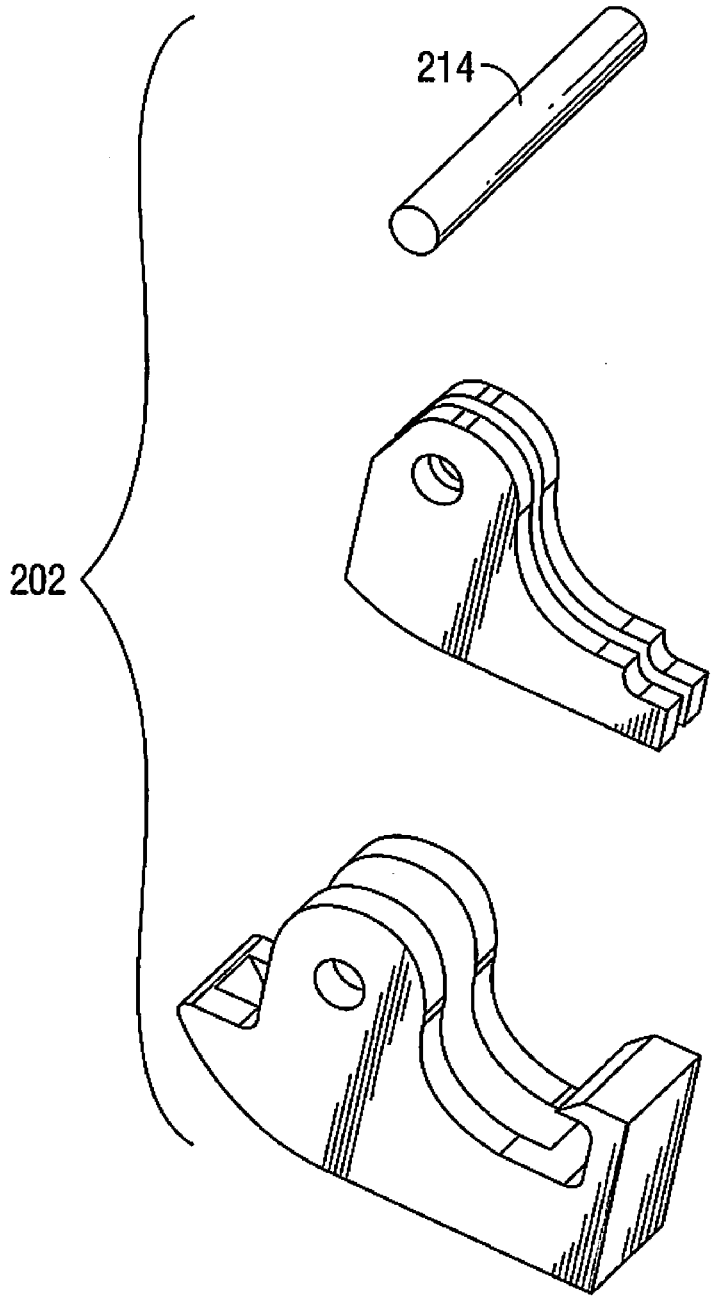
FIGS. 12-14 are perspective views of an element and its components for use with the wire termination subassembly of the present disclosure.
Figure 13:
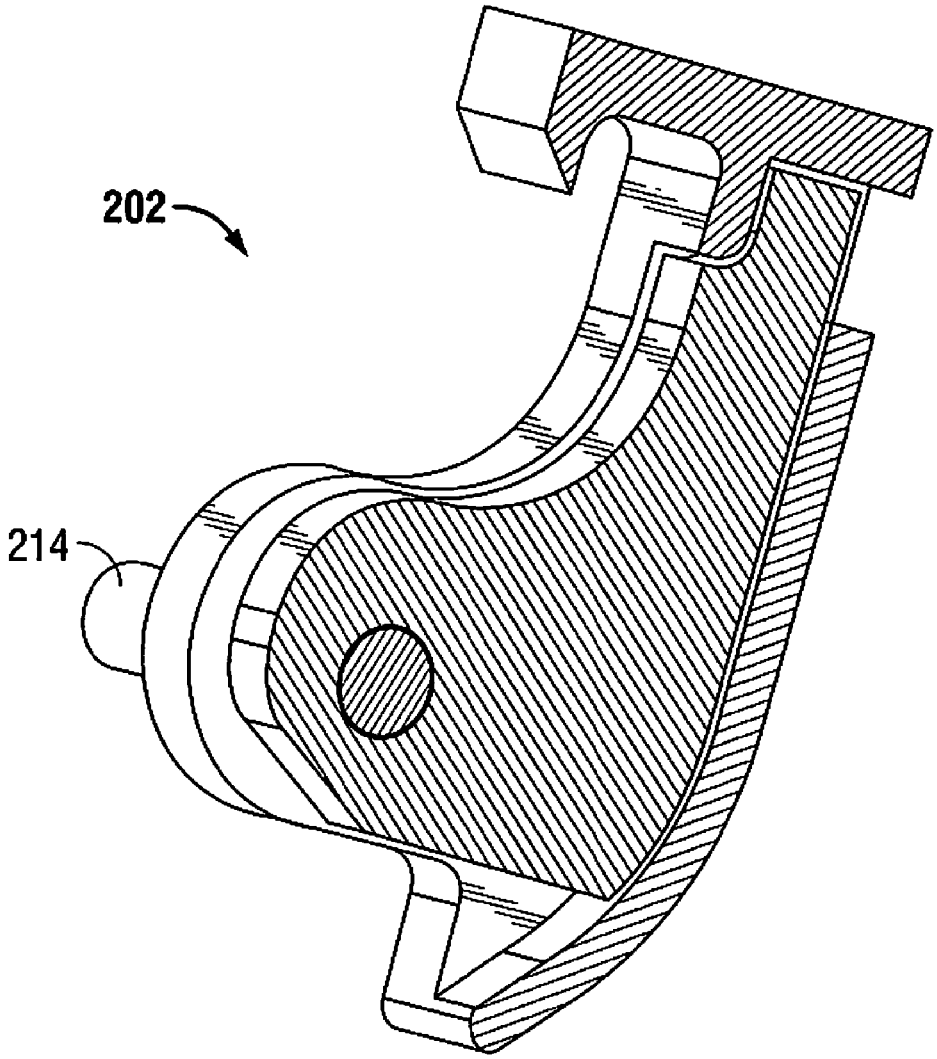
Figure 14:
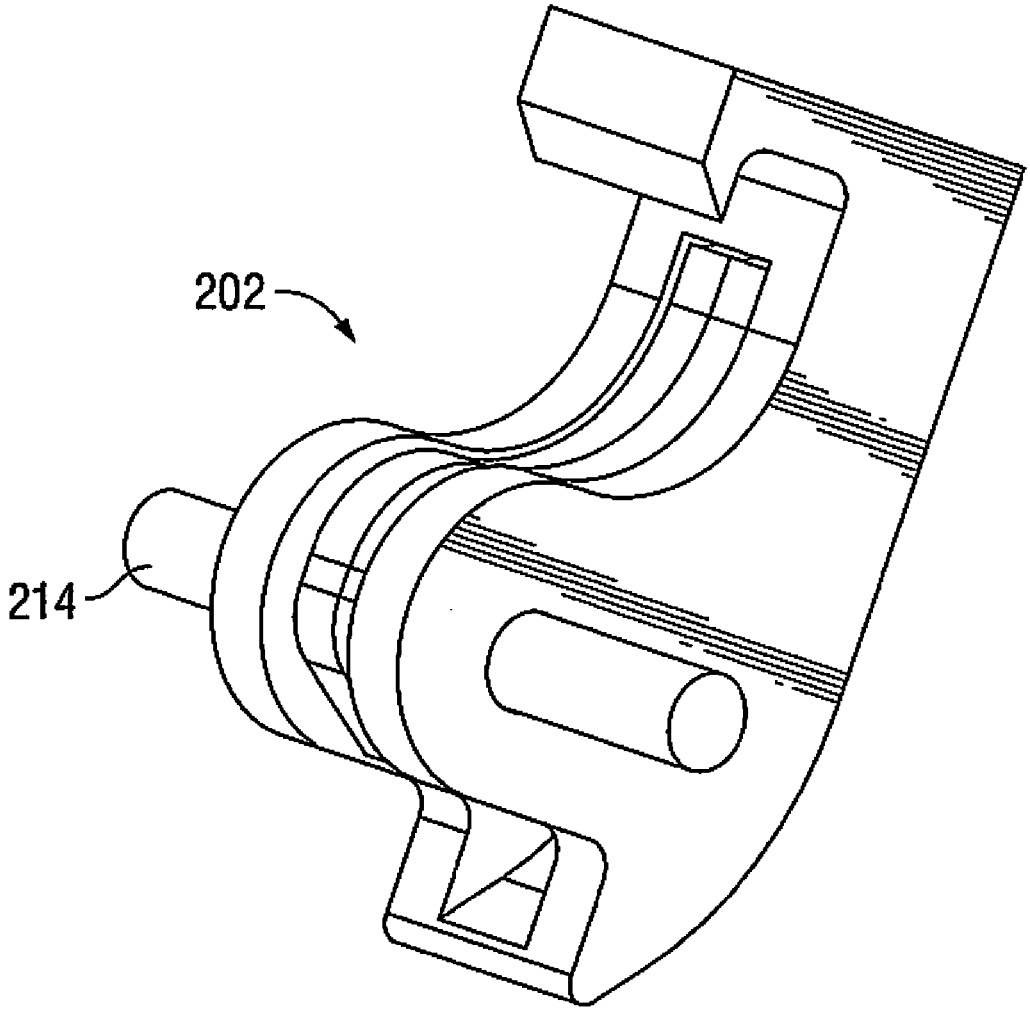

With reference to FIGS. 12-14, in at least one embodiment, the lever 210 may include a lever body with a channel and a pocket at a distal end, a lever core, and a pin. The pocket is disposed to receive a tab on the lever core. The lever core may be then inserted/rotated into the channel in the lever body and into alignment with the lever body. Then the pin can be inserted through the lever body and the lever core, securing the assembly together without the need for additional fasteners or parts. The pin may be secured to the lever body and/or lever core via a press, interference, or any other suitable fit.

Figure 6:
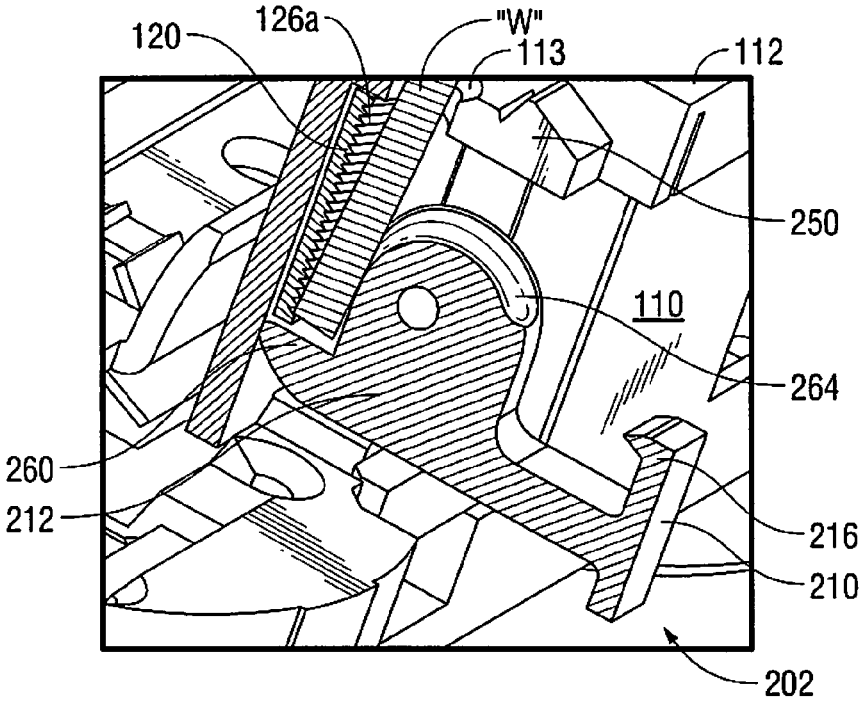
FIG. 6 is an enlarged perspective view of a wire inserted into the wiring device of FIGS. 1-4 and with the element in its first position.
Figure 7:
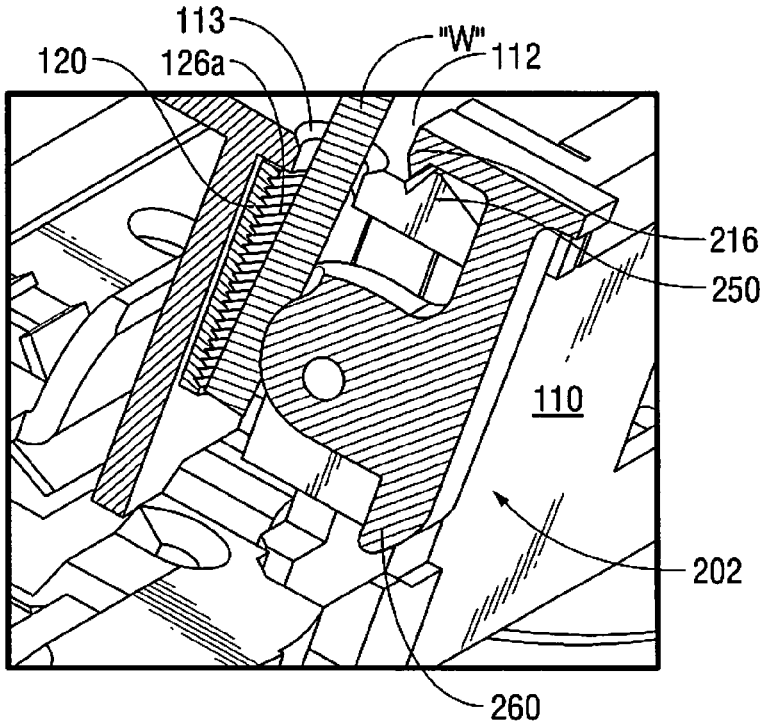
FIG. 7 is an enlarged perspective view of a wire inserted into the wiring device of FIGS. 14 and 6 and with the element in its second position.

With continued reference to FIG. 5, conductive member 120 includes a V-like portion 126 having two legs 126*a*, 126*b*. It is envisioned that each leg 126*a*, 126*b* is configured to simultaneously contact a wire "W." In addition, one or both of legs 126*a*, 126*b* could be adapted and configured to have a textured surface for enhanced termination/gripping of wire W; e.g., serrations, teeth, or the like. FIGS. 6 and 7 illustrate the wire "W" in contact with a single leg 126*a*, while the other leg 126*b* is not explicitly shown for clarity. Alternatively, conductive member 120 may include a flat portion, as opposed to a V-like portion 126, to contact the wire. In at least one embodiment, if conductive member 120 includes a V-like portion 126, the profile of cam 212 may be flat. Alternatively, if conductive member 120 includes a flat portion, the profile of cam 212 may be flat in the center with the outer edges being extended to aid in centering the wire in the termination.

Referring now FIG. 5A, there is shown an alternate embodiment to that shown in FIG. 5. The embodiment in FIG. 5A is similar to the embodiment shown in FIG. 5 with some differences. On one side each of lever (not shown in FIG. 5A) is located a flexible wing 141. Flexible wing 141 is provided such that a larger size wire, # 12 AWG for example, can be more easily accommodated. Flexible wing 141 makes it easier for the contact to flex an extra amount when using a larger size wire as opposed to a smaller wire size, # 14 AWG for example. For example, the extra amount of flexing may be in the order of about 0.020 inches.

In addition, a window or cutout region 127 is provided on the center of contact opposite the lever as opposed to a scoreline. The window 127 provides for two sharp corners or edges that engage the wire to be terminated instead of engaging the wire with a scoreline. The provision of windows 127 may be provided as opposed to the scoreline in order to simplify the manufacturing process.

As shown in the embodiment depicted in FIG. 5, element 202 is pivotally mounted within a portion of conductive member 120. More particularly, pin 214 of element 202 is configured to engage a recess, or mounting region 122 of conductive member 120. As can be appreciated, the interaction between pin 214 and recess 122 facilitates the pivotal relationship between element 202 and conductive member 120. It is envisioned that recess 122 has a constant width (not shown) or includes a rounded portion (as shown in FIG. 5, for example). The rounded portion, in conjunction with the resilient member 142, provide tolerances to accommodate various gauge wires (e.g., 12- and 14-gauge).

Figure 9:
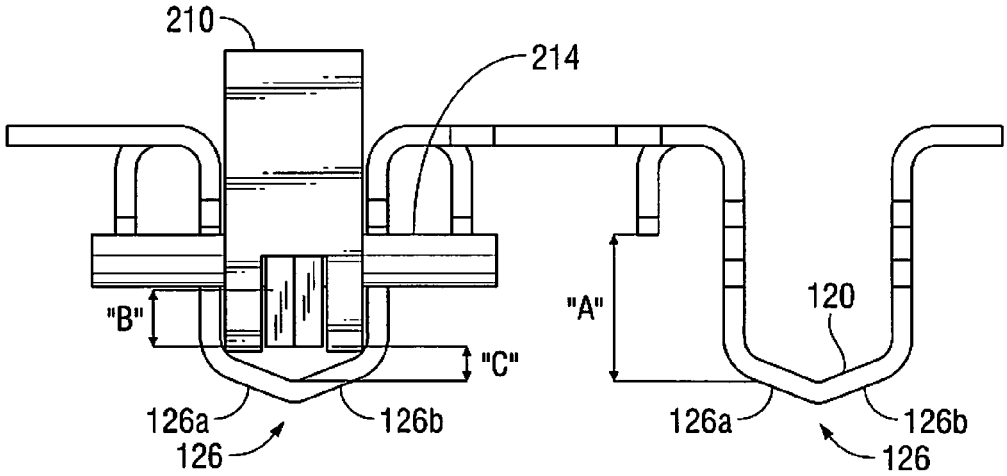
FIG. 9 is a top view of a portion of a wire termination subassembly according to embodiments of the present disclosure.

With reference to FIG. 9, dimensions "A," "B" and "C" are shown and help illustrate how having element 202 being pivotable about a portion of conductive member 120 helps minimize the manufacturing tolerances. That is, by assembling elements 202 into conductive member 120, the tolerance chain is reduced to only two dimensions, i.e., dimensions "A" and "B." That is, the critical dimension "C" is solely dependent on dimensions "A" and "B." Moreover, lower portion 112 and upper portion 114 of housing 110 have no effect on the system tolerance. In this embodiment, as opposed to other embodiments, the tolerance chain is relatively shorter, part complexity is lower, and assembly is relatively less complicated. Such an embodiment may be less expensive to produce and yield less waste during production.

Referring back to FIG. 5, conductive member 120 is shown in one embodiment including a two pairs of resilient members 140*a*, 140*b*. Resilient members 140*a*, 140*b* are configured for biasing pin 214 of element 202. In the illustrated embodiment, each terminal (i.e., first terminal 120*a* and second terminal 120*b*) includes a respective pair of resilient members 140*a*, 140*b* and each resilient member 140 is formed from a portion of conductive member 120 and protrudes inwardly from an outer surface 124 of conductive member 120. At least a portion of resilient member 140, e.g., an end 142 of resilient member 140 is arranged and configured to contact pin 214 of element 202 and bias a wire W inserted into the V-like portion 126 against the surfaces 126*a*, 126*b*. In this embodiment, at least one pair of resilient member 140*a*, 140*b* for each terminal 120*a*, 120*b* is configured to be able to flex towards surface 124 in response to a predetermined amount of force acting there against. Moreover, the interaction between element 202, V-like portion 126 of conductive member 120, and resilient member 140 facilitates securement of wires of different gauges (i.e.—sizes) with conductive member 120. More particularly, upon insertion of a wire having a sufficiently large gauge (i.e., one that would cause at least one of the resilient member pairs 140*a*, 140*b* to deform or flex), at least one of the resilient member pairs 140*a*, 140*b* would flex towards outer surface 124 to accommodate the wire, which would allow pin 214 of element 202 to be urged/biased towards outer surface 124.

With reference to FIGS. 6 and 7, element 202 is movable between a first position (FIG. 6), where a wire "W" in insertable between cam 212 and a portion of conductive member 120, and a second position (FIG. 7), wherein the wire "W" is secured between cam 212 and a portion of conductive member 120. Moreover, a user can move element 202 from its first position, to its second position without the use of a tool; e.g. a user could actuate element 202 by hand alone, i.e., without requiring a screwdriver, etc. In an alternative embodiment, the user could move element 202 from its first position, to its second position with the use of, or with the help of, a tool. Thus, in certain embodiments, the wire "W" may be tool-lessly securable and removably secured in electrical communication with conductive member 120 That is, element 202 is movable in the general direction of arrow "A-A" in FIG. 1. As shown, the portion of wiring device between cam 212 and conductive member 120, i.e., a wire-accepting slot or region 125, defines a second longitudinal axis "B-B," which is substantially perpendicular to first longitudinal axis "A-A" (see FIG. 5). Although in this embodiment axes "A-A" and "B-B" are perpendicular to each other, the axes may be disposed at any suitable angle with respect to each other. It is envisioned that wire-accepting slot or channel 125 includes a constant width or a varying width.

When used herein, the term "tool-lessly" refers to a wire termination mechanism that may be actuated without the need or use of a tool or implement, e.g., hand-operable. This may include the ability to operate/actuate the wire termination mechanism both to secure a wire and to release a wire. However, it should be clear that the actuators of the wire termination mechanisms which are adapted and configured to be manually operable without the need or use of a tool or implement, may still be conceivably operated with a suitably selected tool or implement; i.e., tool-lessly operable wire termination mechanisms do not necessarily exclude manual operation by means of a tool or implement.

With continued reference to FIGS. 6 and 7, element 202 may be temporarily locked into place (e.g., in its second position) when a portion of element 202 (e.g., an element locking structure 216) engages a housing locking structure 250 disposed on a portion of wiring device 100. It is further envisioned that engagement between element locking structure 216 and housing locking structure 250 provides the user with user-perceptible feedback (e.g., tactile or audible) signifying that element 202 is locked in place. Element and housing locking structures 216, 250 are envisioned as being complementary mechanical locking mechanisms which cooperate to selectively lock element 202 into its second position; e.g., an over snap latch, a ratcheting finger, or the like.

Additional contemplated features of element 202 will now be described with reference to FIGS. 6 and 7. In the illustrated embodiments, element 202 includes a finger 260 thereon. It is envisioned that when element 202 is in its first position (FIG. 6), finger 260 functions as a wire stop. That is, finger 260 may guide a user to position a wire at a desirable depth adjacent conductive member 120. When element 202 is in its second position (FIG. 7), finger 260 may help limit external access to within housing 110. That is, finger 260 may help prevent a user from unintentionally contacting conductive member 120. Further, it is envisioned that element 202 may include a channel 264 disposed along at least a portion of a wire-contacting surface thereof. It is further envisioned that the radius of channel 264 may be non-constant. That is, the radius of channel 264 may increase or decrease towards the location where finger 260 is illustrated. Channel 264 may help a user guide a wire between element 202 and conductive member 120.

Alternatively, in at least one embodiment, finger 260 may be omitted and instead the housing, or other suitable element, may be configured to limit or stop the lever near it's first position. If finger 260 is omitted, the termination may be configured such that the wire-accepting slot 125 is uninterrupted by the lever or a portion thereof at any point of the range of motion of the lever between it's first and second positions.

Figure 8:
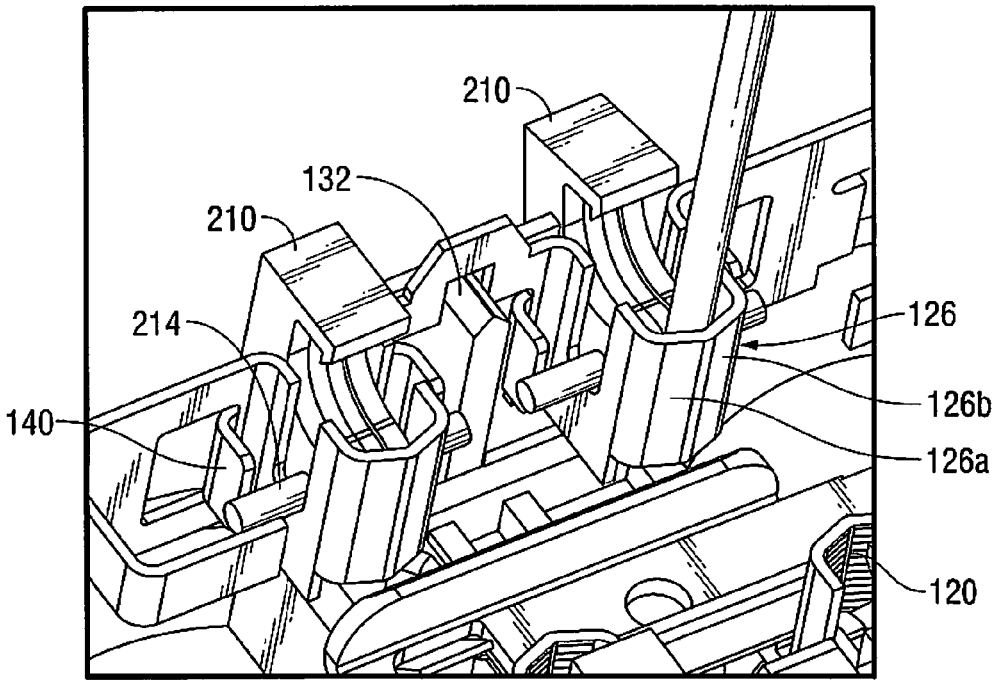
FIG. 8 is a perspective view of a portion of a wiring device of the present disclosure shown with a portion of the housing removed.

Referring back to FIGS. 1 and 3, it is envisioned that a portion of housing 110 includes a break-away portion 1111 (FIG. 1). Break-away portion 111 is configured to conceal a connecting portion 121 or conductive break-away portion (FIG. 4) of conductive member 120. Connecting portion 121 is the bridge between first terminal 120*a* and second terminal 120*b* of conductive member 120 (FIG. 5). To access and sever the connecting portion 121 (e.g., to electrically separate the two terminals), a user can sever break-away portion 111 from the other portions of housing 110 by use of a mechanical force or via a separate tool. Additionally, housing 110 may include a rib 130 (and/or rib 132 shown in FIG. 8) disposed thereon, which is positioned such that rib 130 (and/or rib 132) is substantially aligned between, or adjacent to the two terminals of conductive member 120. It is envisioned that rib 130 (and/or rib 132) helps physically separate and maintain the position the two terminals after connecting portion 121 has been severed. It is further envisioned that rib 130 (and/or rib 132) helps key (e.g. register/align) the cover portion 114 with respect to base portion 112 to help ensure proper assembly.

The present disclosure also relates to a wire termination subassembly 200 for use with a wiring device 100. The wire termination subassembly 200 includes a conductive member 120, and an element 202 disposed in mechanical cooperation with the conductive member 120. The element 202 is pivotable about a portion of the conductive member 120 between a first position where a wire is insertable between the element 202 and a portion of the conductive member 120, and a second position where the wire is secured between the element 202 and a portion of the conductive member 120. In disclosed embodiments, the element 202 is tool-lessly movable between its first position and its second position.

As can be appreciated, wire termination subassembly 200 facilitates the insertion and removal of a wire "W" with respect to wiring device 100. To secure a wire "W" into wire termination subassembly 200 of wiring device 100, a user (a licensed electrician, homeowner, or the like) can position lever 210 in its first, open position, insert a portion of wire "W" (e.g., a bare stripped portion of wire W) between cam 212 and conductive member 120, and move lever 210 towards its second, closed position, such that a portion of cam 212 moves towards the wire, thus firmly securing wire "W" between cam 212 and conductive member 120. To remove wire "W" from wire termination subassembly 200 of wiring device 100, the user moves lever 210 from its second, closed position towards its first, open position. This movement of lever 210 causes cam 212 to release wire "W," such that wire "W" is free to longitudinally translate, thus allowing the user to remove the wire "W" from wiring device 100.

Figure 10:
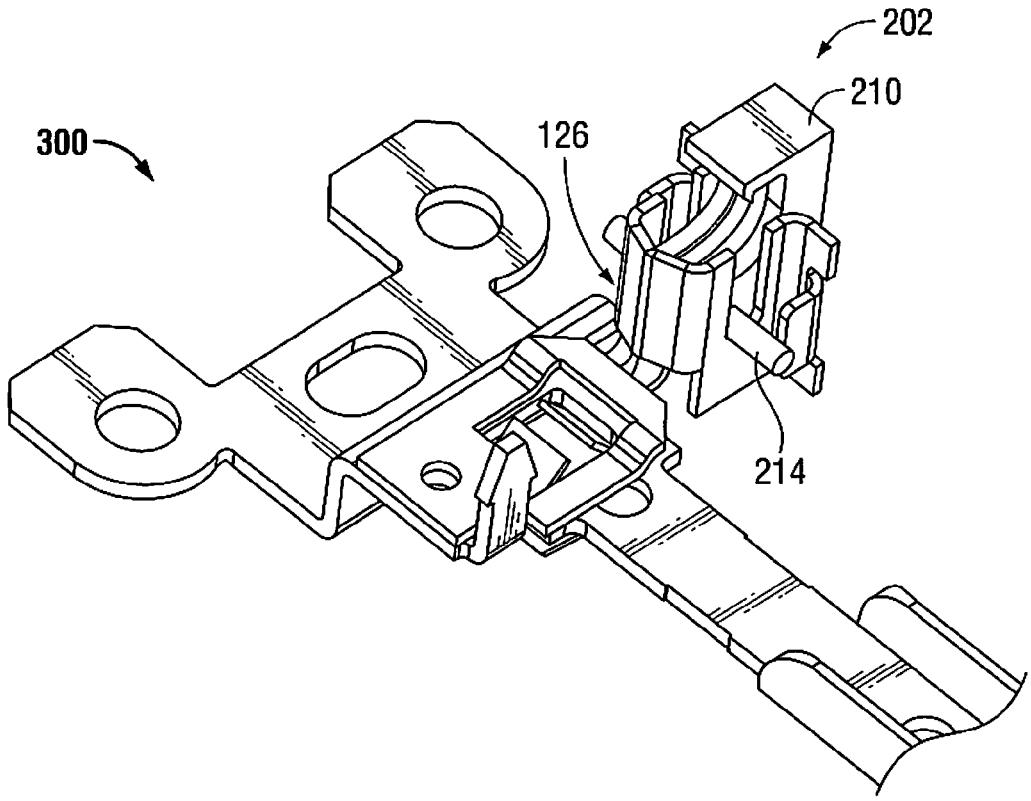
FIG. 10 is a perspective view of a ground terminal subassembly of a wiring device of the present disclosure.
Figure 11:
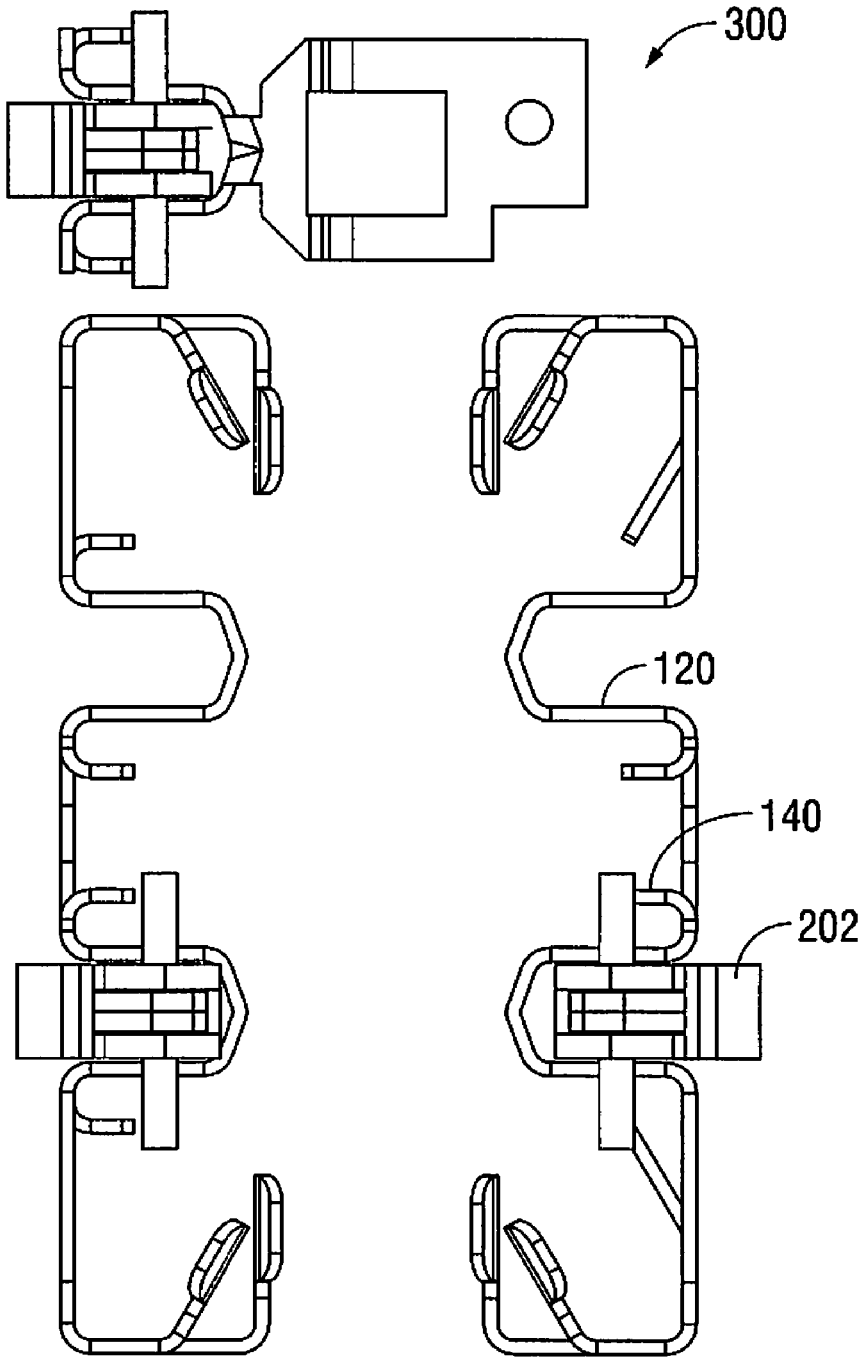
FIG. 11 is a top view of a portion of a wire termination subassembly according to embodiments of the present disclosure.

The illustrated embodiments of wiring device 100 show five separate elements 202. It is envisioned that each terminal 120*a*, 120*b* includes one element 202 associated therewith Additionally, while not explicitly shown, it is envisioned that wire termination subassembly 200 including element 202 can be used in combination with other types of wire termination subassemblies. Additionally, FIG. 10 illustrates an embodiment of a ground terminal 300, and FIG. 11 illustrates wire termination subassembly 200 and ground terminal 300.

The present disclosure also relates to a method of wiring an electrical device 100. The method includes the steps of providing an electrical device 100 including a conductive member 120 and an element 202, inserting a portion of a wire "W" such that a portion of the wire "W" contacts the conductive member 120, and tool-lessly moving the element 202 with respect to the conductive member 120 to secure a portion of the wire "W" in contact with the conductive member 120.

In various embodiments, the method may also include the following steps:

tool-lessly moving the element 202 with respect to the conductive member 120 to release the portion of the wire "W" from contact with the conductive member 120; and tool-lessly removing the wire from the electrical device.

While several embodiments of the disclosure have been shown in the drawings and/or discussed herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. An electrical distribution wiring device comprising:

a housing having a plurality of wire terminations;

at least one of the plurality of wire terminations comprising:

a conductive member at least partially disposed within said housing;

a lever rotationally mounted to the conductive member and being manually rotatable between at least a first position and a second position, the lever including a rotational axis and an eccentric surface defined with respect to the axis;

wherein the lever in the first position allows a wire to be inserted into the wire termination and the lever in the second position causes the eccentric surface to secure the wire to the conductive member.

2. The electrical distribution wiring device of claim 1, wherein the conductive member includes a V-like shape having two legs configured to receive the wire.

3. The electrical distribution wiring device of claim 1, wherein the conductive member includes a flat portion.

4. The electrical distribution wiring device of claim 1, further comprising a resilient member, and where the resilient member is disposed to bias the eccentric surface towards the conductive member.

5. The electrical distribution wiring device of claim 4, wherein the resilient member, the lever and the conductive member are configured to interact with one another to allow securement of wires of different gauges with the conductive member.

6. The electrical distribution wiring device of claim 1, wherein all exposed surfaces of the electrical distribution wiring device which can be contacted by a human finger are electrically isolated from line voltage when the lever is in its second position.

7. The electrical distribution wiring device of claim 1, wherein the conductive member includes a plurality of serrations configured for enhanced gripping of a wire.

8. The electrical distribution wiring device of claim 1, wherein the housing includes a plurality of openings extending therethrough, and wherein each of the openings is configured to accept a portion of a wire therethrough.

9. The electrical distribution wiring device of claim 1, wherein the lever includes an element locking structure and the housing includes a housing locking structure, the element locking structure being configured to engage the housing locking structure when the lever is moved towards its second position.

10. The electrical distribution wiring device of claim 9, wherein engagement between the element locking structure and the housing locking structure provides a user with at least one of an audible and tactile feedback.

11. The electrical distribution wiring device of claim 1, further comprising a wire-accepting region configured to receive the wire wherein the housing is configured to limit the rotation of the lever such that the wire-accepting region is uninterrupted by the lever when the lever is in its first position, second position, or any position therebetween.

12. The electrical distribution wiring device of claim 1, wherein the lever includes a wire stop disposed thereon to restrict the depth of wire insertion when the lever is in its first position.

13. The electrical distribution wiring device of claim 12, wherein the wire stop limits access to within the housing when the lever is in its second position.

14. The electrical distribution wiring device of claim 1, wherein the eccentric surface includes a channel disposed at least partially therein.

15. The electrical distribution wiring device of claim 14, wherein the channel includes at least a first radius.

16. The electrical distribution wiring device of claim 14, wherein the channel includes a length and a radius, the radius varying along the channel length.

17. The electrical distribution wiring device of claim 1, wherein the lever includes a reinforcing member disposed along the rotational axis.

18. The electrical distribution wiring device of claim 17, wherein at least a portion of the lever comprises a non-conductive material.

19. The electrical distribution wiring device of claim 18, wherein the lever further comprises an integral shaft and a bore therethrough, the integral shaft comprising a nonconductive material, the reinforcing rod being disposed within the bore.

20. The electrical distribution wiring device of claim 1, the conductive member further comprising a first terminal, a second terminal and a conductive member breakaway portion that connects the first terminal with the second terminal;

wherein the housing includes a housing breakaway portion, the housing breakaway portion being configured to at least partially shield the conductive member breakaway portion.

21. The electrical distribution wiring device of claim 20, the housing further comprising a rib disposed adjacent to the conductive member breakaway portion;

wherein the rib is configured to maintain separation of the first terminal from the second terminal upon removal of the conductive breakaway portion.

22. The electrical distribution wiring device of claim 1, wherein the conductive member includes a wire-accepting region which defines an insertion axis.

23. The electrical distribution wiring device of claim 22, wherein the wire-accepting region comprises a channel.

24. The electrical distribution wiring device of claim 22, wherein the rotational axis is substantially perpendicular to the insertion axis.

25. The electrical distribution wiring device of claim 23, wherein the wire-accepting channel has a substantially constant width along the insertion axis.

26. The electrical distribution wiring device of claim 23, wherein the wire-accepting channel has a varying width along the insertion axis.

27. The electrical distribution wiring device of claim 23, wherein the wire-accepting channel includes a cutout region.

28. The electrical distribution wiring device of claim 1, wherein the lever is a hand operable lever.

29. The electrical distribution wiring device of claim 1, wherein the housing further includes a base portion, the wire being insertable through the base portion into one of the plurality of wire terminations when the lever is in the first position.

30. The electrical distribution wiring device of claim 1, wherein the wire is partially stripped.

31. A wiring device, comprising:

a housing;

a wire termination subassembly disposed at least partially within the housing, the wire termination subassembly comprising:

a conductive member;

an element rotationally mounted to the conductive member and disposed in mechanical cooperation with the conductive member, the element being pivotable about a first axis between a first position where a wire is insertable between the element and a portion of the conductive member, and a second position where the wire is removably secured between the element and a portion of the conductive member; and wherein the element is manually movable between the first position and the second position.

32. The wiring device of claim 31, the conductive member further comprising at least one resilient member formed therein, wherein the at least one resilient member is configured to contact a portion of the element.

33. The wiring device of claim 32, wherein the at least one resilient member, the element and the conductive member mechanically cooperate to allow securement of wires having different gauges.

34. The wiring device of claim 31, wherein the conductive member includes a wire-accepting channel which defines an insertion axis.

35. The wiring device of claim 34, wherein the wire-accepting channel includes a V-like portion.

36. The wiring device of claim 34, wherein the wire-accepting channel includes a flat portion.

37. The wiring device of claim 34, wherein the first axis is substantially perpendicular to the insertion axis.

38. The wiring device of claim 34, wherein the wire-accepting channel has a substantially constant width along the insertion axis.

39. The wiring device of claim 34 wherein the wire-accepting channel has a varying width along the insertion axis.

40. The wiring device of claim 34, wherein the wire-accepting channel includes a cutout region.

41. The wiring device of claim 31, the element further comprises a wiring-contacting portion and a channel disposed therein.

42. The wiring device of claim 41, wherein the channel includes at least a first radius.

43. The wiring device of claim 41, wherein channel includes a length and a radius, the radius varying along the channel length.

44. The wiring device of claim 43, wherein the varying radius of the channel defines an eccentric cam surface.

45. The wiring device of claim 31, wherein the conductive member includes a wire-accepting region having a plurality of serrations.

46. The wiring device of claim 31, wherein the element includes an element locking structure thereon which is configured to selectively engage a housing locking structure disposed on the housing when the element is moved towards its second position.

47. The wiring device of claim 46, wherein engagement between the element locking structure and the housing locking structure provides a user-perceptible indication.

48. The wiring device of claim 47, wherein the user-perceptible indication includes at least one of an audible and tactile indication.

49. The wiring device of claim 31, wherein the conductive member includes a resilient member formed therein, and wherein the resilient member is configured to contact a portion of the element.

50. The wiring device of claim 49, wherein the resilient member, the element and the conductive member are configured to mechanically cooperate to allow securement of wires having different gauges.

51. The wiring device of claim 31, the element further comprising a pivot portion wherein the pivot portion includes a reinforcing member.

52. The wiring device of claim 51, wherein at least a portion of the element comprises a non-conductive material.

53. The wiring device of claim 31, wherein the element is hand operable.

54. The wiring device of claim 51, wherein the element comprises:

a lever body comprising a pocket and a channel; and a lever core comprising a tab;

wherein the lever core is at least partially disposed within the channel of the lever body such that the tab is at least partially disposed within the pocket in the lever body and the reinforcing member is at least partially disposed through the lever body and lever core.

55. The wiring device of claim 31, wherein the housing further includes a base portion, the wire being insertable through the base portion and between the element and the portion of the conductive member when the element is in the first position.

56. The wiring device of claim 31, wherein the wire is partially stripped.

57. A wire termination, comprising:

a conductive member;

a lever rotationally mounted to the conductive member and being manually rotatable between at least a first position and a second position, the lever including a rotational axis and an eccentric surface defined with respect to the axis;

wherein the lever in the first position allows a wire to be inserted between the lever and the conductive member, and the lever in the second position causes the eccentric surface to secure the wire to the conductive member.

58. The wire termination of claim 57, wherein the wire is partially stripped.

59. A wire termination, comprising:

a conductive member;

an element rotationally mounted to the conductive member and disposed in mechanical cooperation with the conductive member, the element being pivotable about a first axis between a first position where a wire is insertable between the element and a portion of the conductive member, and a second position where the wire is removably secured between the element and a portion of the conductive member;

wherein the element is manually movable between the first position and the second position.

60. The method for terminating a wire of claim 59, wherein the inserting step comprises inserting the wire through a base portion of a housing.

61. The method for terminating a wire of claim 59, wherein the wire is partially stripped.

62. A method for terminating a wire, comprising:

providing a lever rotationally mounted to a conductive member;

manually moving the lever to a first position to allow a portion of a wire to be inserted between the conductive member and an eccentrically cammed surface of the lever;

inserting a portion of the wire between the conductive member and the eccentrically cammed surface of the lever; and manually moving the lever to a second position to removably secure the wire between the conductive member and the eccentrically cammed surface of the lever such that the wire is manually removable from between the conductive member and the eccentrically cammed surface of the lever upon the return of the lever to the first position.

63. The method for terminating a wire of claim 62, wherein the step of inserting the portion of the wire between the conductive member and the eccentrically cammed surface of the lever comprises inserting the wire through a base portion of a housing.

64. The method for terminating a wire of claim 62, wherein the wire is partially stripped.

65. A method of manufacture for an electrical termination of a wiring device, the method including the steps of:

mounting a conductive member at least partially within the wiring device, the conductive member including at least one inwardly extending resilient member, a mounting region having at least a first width, and a wire-contact portion; and mounting a wire termination mechanism within the mounting region of the conductive member, the wire termination mechanism having a shaft and being pivotable about the shaft between at least a first position and a second position, the wire termination mechanism being constrained within the at least first width of the mounting region by the inwardly extending resilient member, such that manufacturing tolerances are controlled.

* * * * *

UNITED STATES PATENT AND TRADEMARK OFFICE

CERTIFICATE OF CORRECTION

PATENT NO. : 7,963,812 B2
APPLICATION NO. : 12/474640
DATED : June 21, 2011
INVENTOR(S) : Azer Ilkhanov It is certified that error appears in the above-identified patent and that said Letters Patent is hereby corrected as shown below:

Column 10:

Line 36 (Claim 19): "the reinforcing rod being disposed within" should be --the reinforcing member being disposed within--;

Column 12:

Line 63 (Claim 60): "The method for terminating a wire of claim 59," should be --The wire termination of claim 59,--;

Line 64 (Claim 60): "the inserting step comprises inserting the wire through a base" should be --the wire is inserted through a base--;

Line 66 (Claim 61): "The method for terminating a wire of claim 59," should be --The wire termination of claim 59,--.

Signed and Sealed this
Twenty-second Day of November, 2011

David J. Kappos

David J. Kappos
*Director of the United States Patent and Trademark Office*